US009244428B2

(12) United States Patent
Matsumaru

(10) Patent No.: US 9,244,428 B2
(45) Date of Patent: Jan. 26, 2016

(54) PHOTOSENSITIVE CARTRIDGE AND IMAGE FORMING APPARATUS

(71) Applicant: CANON KABUSHIKI KAISHA, Tokyo (JP)

(72) Inventor: Naoki Matsumaru, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/600,992

(22) Filed: Jan. 20, 2015

(65) Prior Publication Data

US 2015/0205256 A1 Jul. 23, 2015

(30) Foreign Application Priority Data

Jan. 21, 2014 (JP) ..... 2014-008934

(51) Int. Cl.
*G03G 21/18* (2006.01)

(52) U.S. Cl.
CPC ..... *G03G 21/1814* (2013.01); *G03G 21/1817* (2013.01); *G03G 2221/1846* (2013.01); *G03G 2221/1853* (2013.01)

(58) Field of Classification Search
CPC ..... G03G 21/18; G03G 21/1803; G03G 21/1814; G03G 21/1817; G03G 21/1821; G03G 21/1825; G03G 21/1842; G03G 2221/1606; G03G 2221/18; G03G 2221/1846; G03G 2221/1853
USPC ..... 399/111, 113
See application file for complete search history.

(56) References Cited

U.S. PATENT DOCUMENTS 9,046,871 B2 * 6/2015 Suzuki ..... G03G 21/1842

FOREIGN PATENT DOCUMENTS

JP 2001-42622 A 2/2001

* cited by examiner

*Primary Examiner* — Christopher Mahoney
(74) *Attorney, Agent, or Firm* — Canon USA, Inc. IP Division

(57) ABSTRACT

A photosensitive cartridge detachably attachable to a main body of an image forming apparatus includes a photosensitive member, an attachment region provided to detachably attach a developing cartridge having a developing member for developing a latent image formed on the photosensitive member, and a grip member configured to be gripped at a time when the photosensitive cartridge is attached to and detached from the main body of the image forming apparatus, the grip member being movable between a first position at which the grip member enters the attachment region in a case where the developing cartridge is not attached to the photosensitive cartridge, and a second position at which the grip member retracts from the attachment region in a case where the developing cartridge is attached to the photosensitive cartridge.

16 Claims, 11 Drawing Sheets

PHOTOSENSITIVE CARTRIDGE AND IMAGE FORMING APPARATUS

BACKGROUND

1. Field of the Invention

The present disclosure relates to a photosensitive cartridge detachable from an image forming apparatus main body and relates to an image forming apparatus.

The photosensitive cartridge has an electrophotographic photosensitive member and is detachable from an electrophotographic image forming apparatus main body. The image forming apparatus forms an image on a recording medium.

Examples of the image forming apparatus include an electrophotographic copying machine, an electrophotographic printer (such as a light emitting diode (LED) printer and a laser beam printer), a facsimile machine, and a word processor.

2. Description of the Related Art

An image forming apparatus using an electrophotographic image forming process forms a latent image, by performing selective exposure according to image information, on a photosensitive drum uniformly charged by a charging device. The latent image is then developed using toner by a developing device to form a toner image. Afterwards, a transfer device transfers the toner image formed on the photosensitive drum to a recording medium, so that an image is formed.

Conventionally, as one type of the above-described image forming apparatus using the electrophotographic image forming process, an image forming apparatus including a photosensitive cartridge and a developing cartridge has been known. The photosensitive cartridge has a photosensitive drum and is detachable from an image forming apparatus main body. The developing cartridge has a developing device and is detachable from the photosensitive cartridge. Such a cartridge type allows a user to perform maintenance of the apparatus by him or herself without relying on a serviceman. Therefore, operability can be greatly improved. One type of such a process cartridge has a handle portion to be gripped by a user at the time when the user attaches/detaches the cartridge to/from an image forming apparatus main body, and many cartridges of this type have been conventionally discussed.

Further, Japanese Patent Application Laid-Open No. 2001-42622 discusses a configuration intended to reduce space for a handle portion and to improve operability of a cartridge. In this configuration, a process cartridge is attached inside an image forming apparatus main body, and a handle portion is accommodated in the cartridge when a main body door of the image forming apparatus main body is closed.

SUMMARY

The present disclosure is directed to a further developed image forming apparatus as compared with the above-described conventional examples.

According to an aspect disclosed herein, a photosensitive cartridge detachably attachable to a main body of an image forming apparatus includes a photosensitive member, an attachment region provided to detachably attach a developing cartridge having a developing member for developing a latent image formed on the photosensitive member, and a grip member configured to be gripped at a time when the photosensitive cartridge is attached to and detached from the main body of the image forming apparatus, the grip member being movable between a first position where the grip member enters the attachment region at a time when the developing cartridge is not attached to the photosensitive cartridge, and a second position where the grip member retracts from the attachment region at a time when the developing cartridge is attached to the photosensitive cartridge.

Further features of the present invention will become apparent from the following description of exemplary embodiments with reference to the attached drawings.

DESCRIPTION OF THE EMBODIMENTS

A first exemplary embodiment will be described below in detail based on the drawings.

Figure 5:
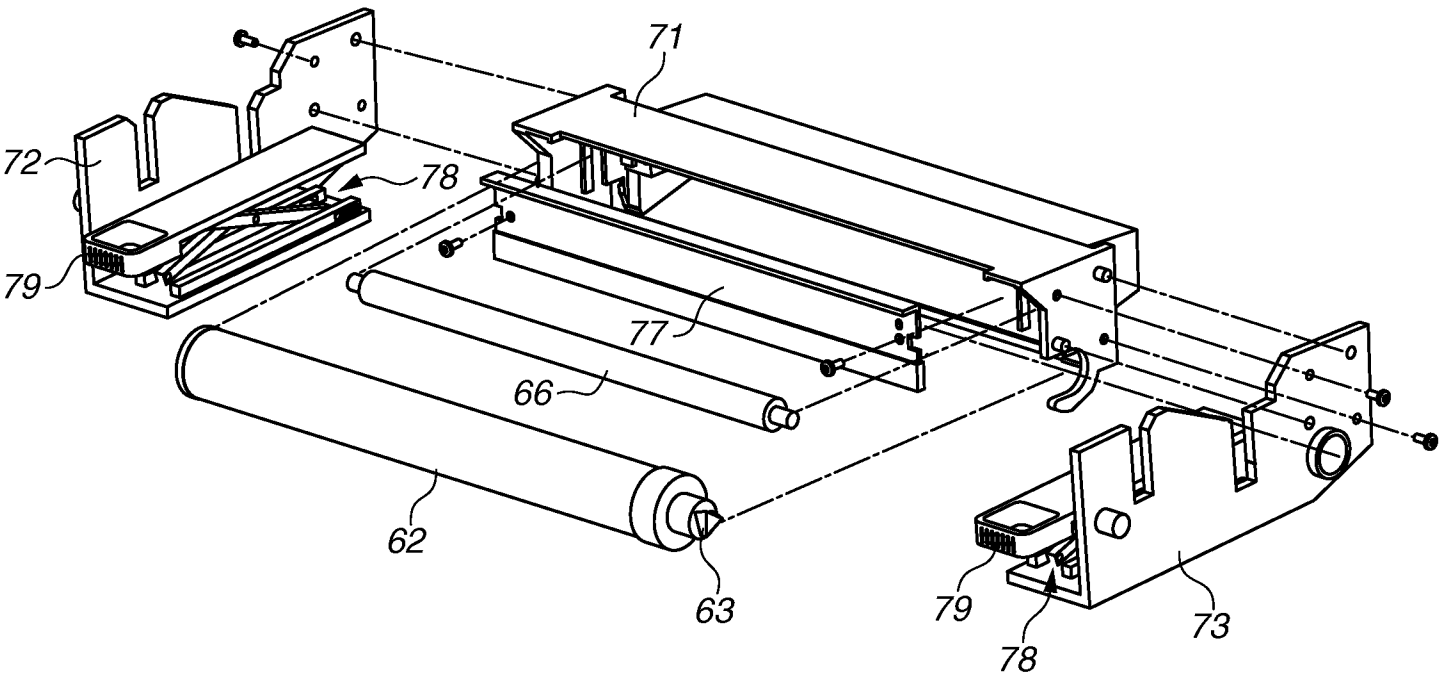
FIG. 5 is a perspective diagram illustrating a method of assembling the photosensitive cartridge.

A rotation axial direction of an electrophotographic photosensitive drum (hereinafter referred to as "drum") is defined as a longitudinal direction. Further, in the longitudinal direction, a side where the drum receives a driving force from an image forming apparatus main body is defined as a drive side (a side where a driving-force receiving portion 63 in FIG. 5 is present), and the other side is defined as a non-drive side.

Figure 2:
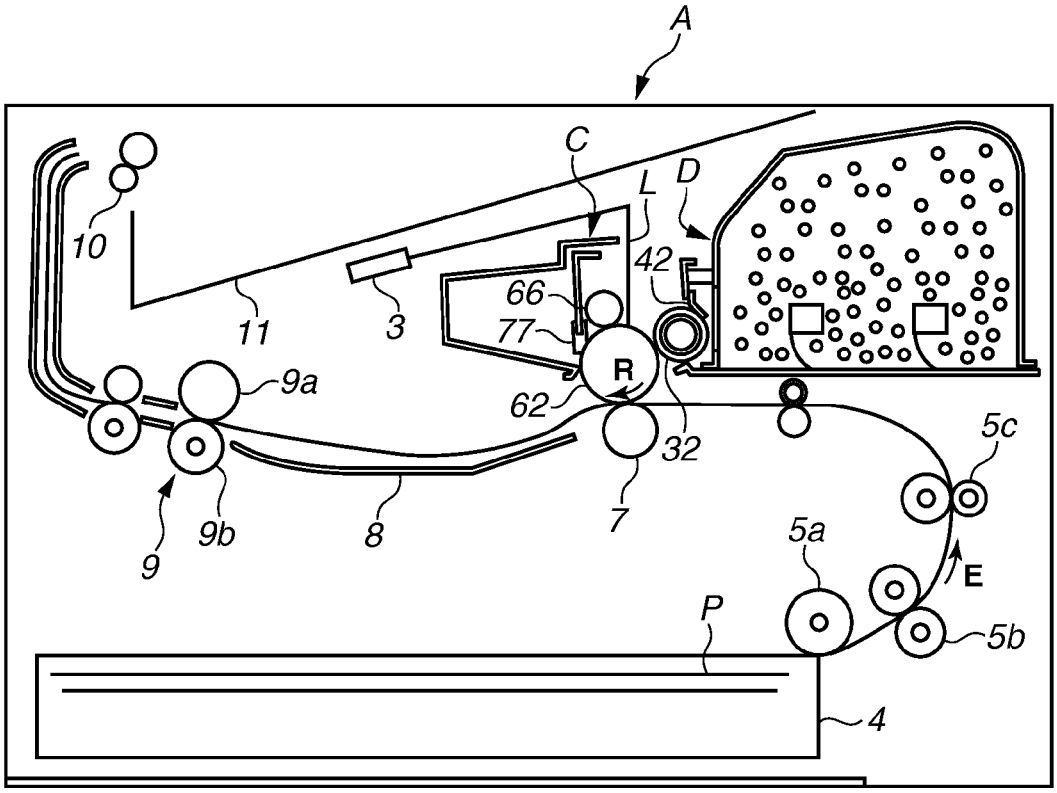
FIG. 2 is a cross-sectional diagram of an image forming apparatus having the photosensitive cartridge to which a developing cartridge is attached.
Figure 3:
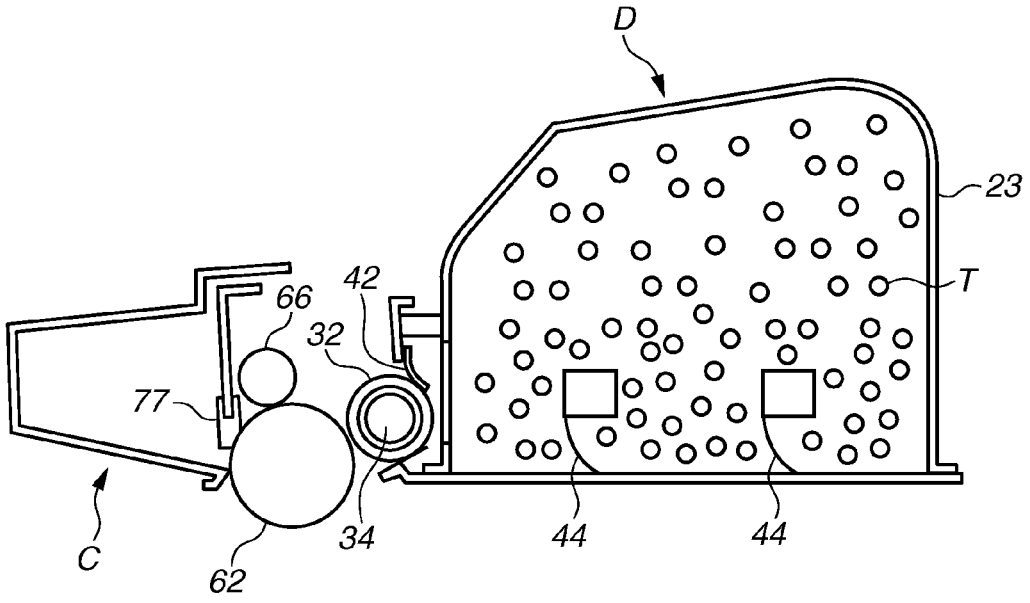
FIG. 3 is a cross-sectional diagram of the photosensitive cartridge to which the developing cartridge is attached.

Next, an overall configuration and an image forming process of an image forming apparatus will be described with reference to FIGS. 2 and 3. FIG. 2 is a cross-sectional diagram of the image forming apparatus where a process cartridge B is attached to a main body A of the image forming apparatus. FIG. 3 is a cross-sectional diagram of the process cartridge B according to the present exemplary embodiment. Here, the main body A of the image forming apparatus is equivalent to an electrophotographic image forming apparatus part except the process cartridge B.

[Overall Configuration of Image Forming Apparatus]

FIG. 2 is a cross-sectional diagram illustrating a state where a photosensitive cartridge C is attached. The photosensitive cartridge C includes a drum 62 and is detachably attachable to the main body A of the image forming apparatus. Further, a developing cartridge D is detachably attached to the photosensitive cartridge C. The photosensitive cartridge C includes, in addition to the drum 62, a charging roller 66 provided to uniformly charge a surface of the drum 62, and a cleaning blade 77 provided to clean toner on the drum 62. On the other hand, the developing cartridge D includes a developing roller 32 serving as a toner carrier containing a magnet roller 34. The developing cartridge D further includes a layer-thickness regulating member 42 that regulates a thickness of the toner on the developing roller 32.

The image forming apparatus is a laser beam printer in which the photosensitive cartridge C is detachably attachable to the main body A of the image forming apparatus and which uses an electrophotographic technique. When the photosensitive cartridge C is attached to the main body A of the image forming apparatus, a beam scanner unit 3 (a laser scanner unit) is disposed on a deep side in an insertion direction of the cartridge B.

Further, a sheet tray 4 is disposed below the photosensitive cartridge C. The sheet tray 4 accommodates a recording medium (hereinafter referred to as "sheet member P") that becomes an image formation target.

Furthermore, the main body A of the image forming apparatus includes a pickup roller 5*a*, a feed roller pair 5*b*, a conveyance roller pair 5*c*, a transfer roller 7, a conveyance guide 8, a fixing device 9, a discharge roller pair 10, and a discharge tray 11, which are disposed in this order along a conveyance direction E of the sheet member P. The fixing device 9 includes a heating roller 9*a* and a pressure roller 9*b*.

[Image Forming Process]

Next, an outline of an image forming process will be described. In response to a print start signal, the drum 62 is driven to rotate at a predetermined circumferential velocity (a process speed) in an arrow R direction. The charging roller 66, to which a bias voltage is applied, is brought into contact with an outer peripheral surface of the drum 62, thereby uniformly charging the outer peripheral surface of the drum 62.

Next, the beam scanner unit 3 outputs a laser beam L according to image information. The laser beam L performs scanning exposure on the outer peripheral surface of the drum 62. As a result, an electrostatic latent image corresponding to the image information is formed on the outer peripheral surface of the drum 62.

On the other hand, as illustrated in FIG. 3, toner T in a toner containing frame 23 of the developing cartridge D is stirred and conveyed by toner stirring sheets 44. The toner T conveyed to the developing roller 32 is carried on the surface of the developing roller 32, as a thin layer having a uniform thickness regulated by the layer-thickness regulating member 42. The toner T is then transferred to the drum 62 according to the electrostatic latent image, to form a visible image as a toner image. In other words, the developing roller 32 is a developing member provided to develop the latent image formed on the drum 62.

Meanwhile, as illustrated in FIG. 2, the sheet member P, which is contained in a lower part of the main body A of the image forming apparatus, is fed from the sheet tray 4 by the pickup roller 5*a*, the feed roller pair 5*b*, and the conveyance roller pair 5*c*, to meet output timing of the laser beam L. The pickup roller 5*a*, the feed roller pair 5*b*, and the conveyance roller pair 5*c* form a conveyance mechanism that conveys the recording medium (the sheet member P). Subsequently, the sheet member P is supplied to a transfer position between the drum 62 and the transfer roller 7, so that the toner image is sequentially transferred from the drum 62 to the sheet member P. The sheet member P to which the toner image has been transferred is separated from the drum 62, and then conveyed to the fixing device 9 along the conveyance guide 8. The sheet member P then passes through a nip portion between the heating roller 9*a* and the pressure roller 9*b* of the fixing device 9. At this nip portion, pressure heat fixing processing is performed so that the toner image is fixed on the sheet member P. After the toner image is fixed, the sheet member P is conveyed to the discharge roller pair 10 and then discharged to the discharge tray 11.

Residual toner on the outer peripheral surface of the drum 62 after the transfer is removed by the cleaning blade 77, and the drum 62 is used again in the image forming process.

[Description of Configuration of Photosensitive Cartridge]

Next, a configuration of the photosensitive cartridge C according to the present exemplary embodiment will be described with reference to FIG. 4. The photosensitive cartridge C includes the drum 62, the charging roller 66, the cleaning blade 77, a grip member 79, and a displacement mechanism 78 that displaces the grip member 79 from a second position to a first position.

Figure 1A:
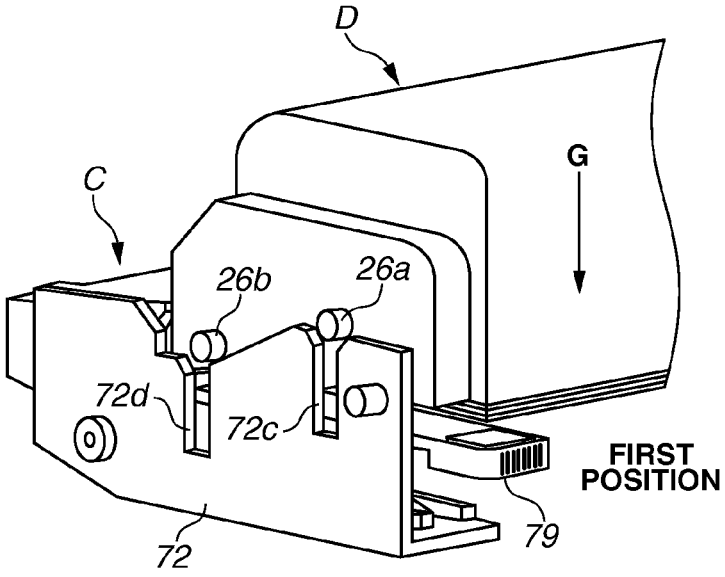
FIGS. 1A, 1B, and 1C illustrate movement of a grip member of a photosensitive cartridge.
Figure 1B:
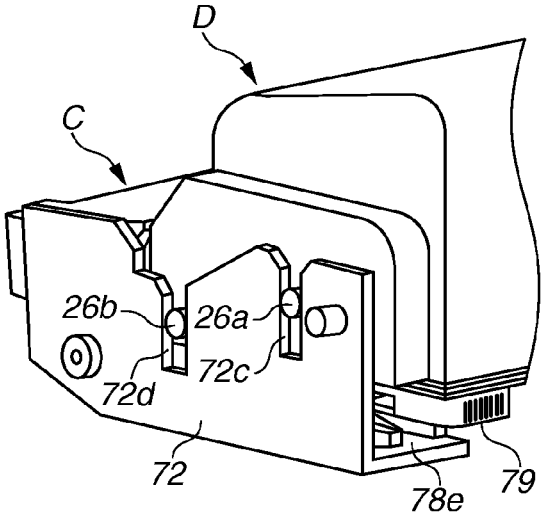
Figure 1C:
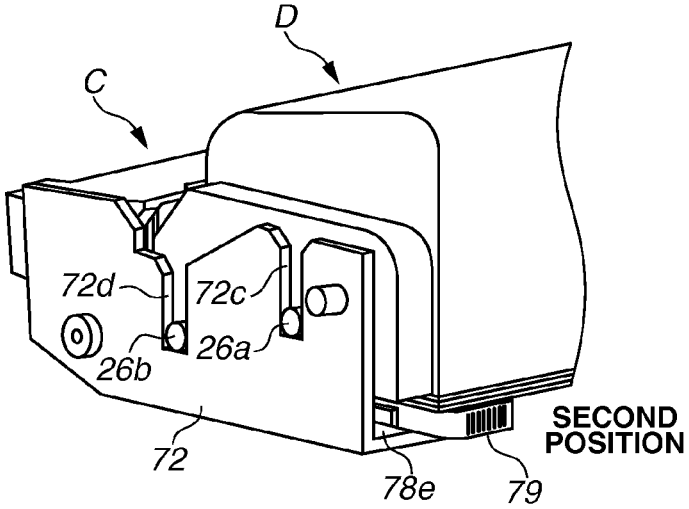
Figure 10:
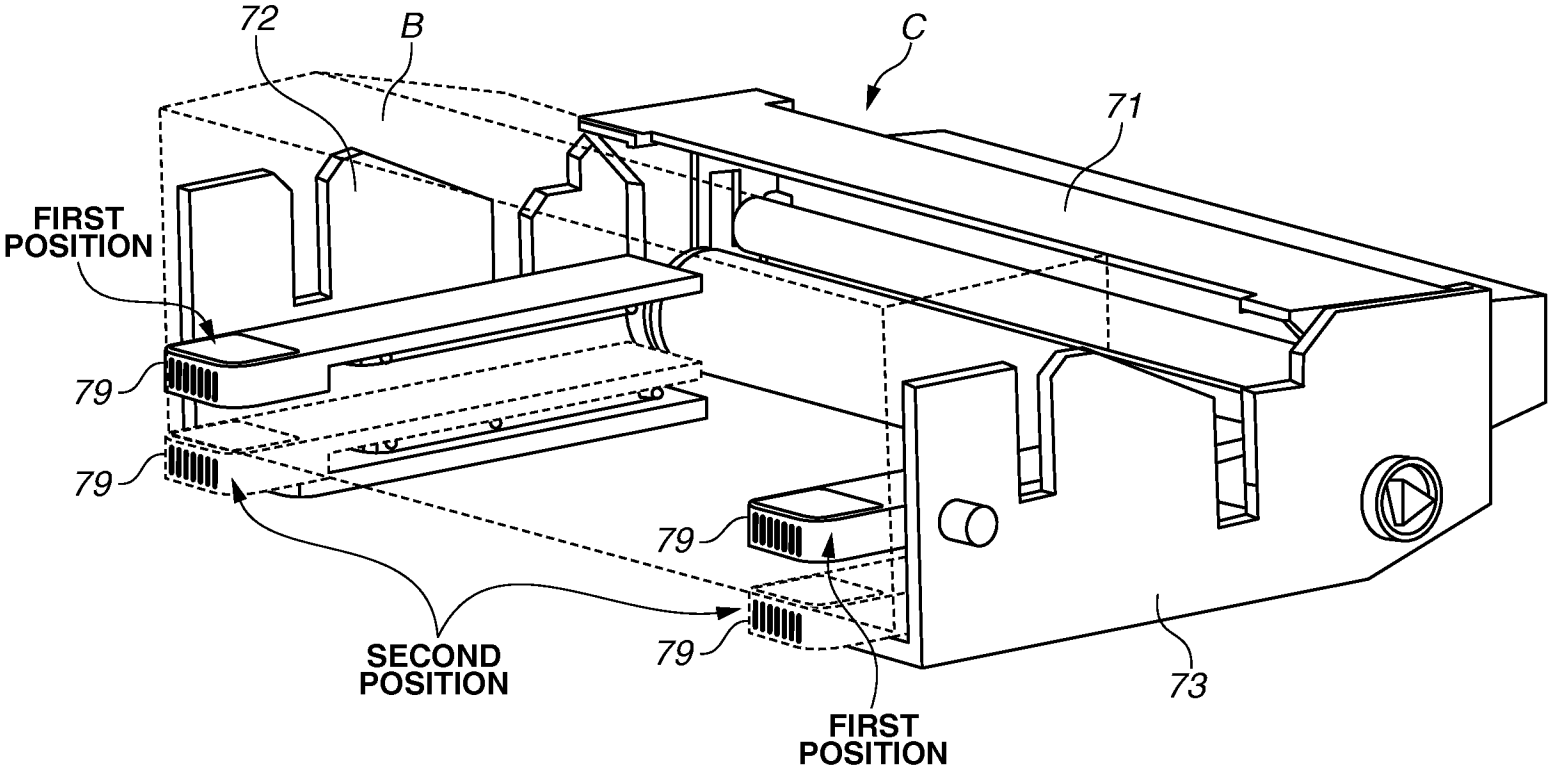
FIG. 10 is a perspective diagram of a state where the grip member of the photosensitive cartridge is at a first position and a state where the grip member is at a second position.

Here, as will be described below, at the first position, the grip member 79 is in a state where the grip member 79 has entered an attachment region B provided to attach the developing cartridge D of the photosensitive cartridge C, as illustrated in FIG. 10. On the other hand, at the second position, the grip member 79 is in a state where the grip member 79 has retracted from the attachment region B, as illustrated in FIGS. 1C and 10.

Next, a method of assembling the photosensitive cartridge C will be described with reference to FIG. 5.

The cleaning blade 77 is fixed to a cleaning frame 71 by screws. The charging roller 66 is rotatably supported by a bearing member (not illustrated) attached to the cleaning frame 71. The drum 62 is rotatably supported on the cleaning frame 71 by a left side cover 72 and a right side cover 73 to each of which the displacement mechanism 78 is attached. The left side cover 72 and the right side cover 73 are fixed to the cleaning frame 71 by screws.

[Description of Grip Member and Displacement Mechanism]

Next, the grip member 79 and the displacement mechanism 78 will be described with reference to FIGS. 4 and 6.

Figure 4:
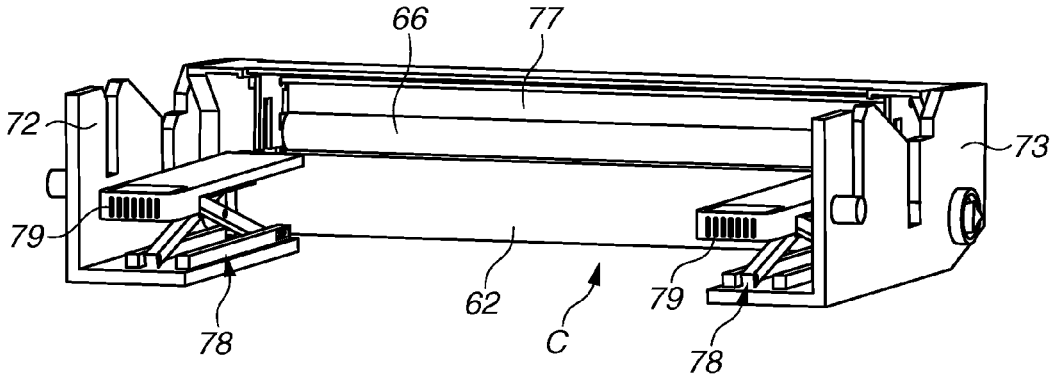
FIG. 4 is a perspective diagram of the photosensitive cartridge.

In the present exemplary embodiment, as illustrated in FIG. 4, the left side cover 72 and the right side cover 73 each include the grip member 79 and the displacement mechanism 78. In other words, in the photosensitive cartridge C, the grip member 79 and the displacement mechanism 78 are provided on each of one end side and the other end side in an axial direction of the drum 62. However, configurations on both sides are similar and therefore, the grip member 79 and the displacement mechanism 78 provided on the side where the left side cover 72 is present as illustrated in FIG. 6 will be described.

Figure 6:
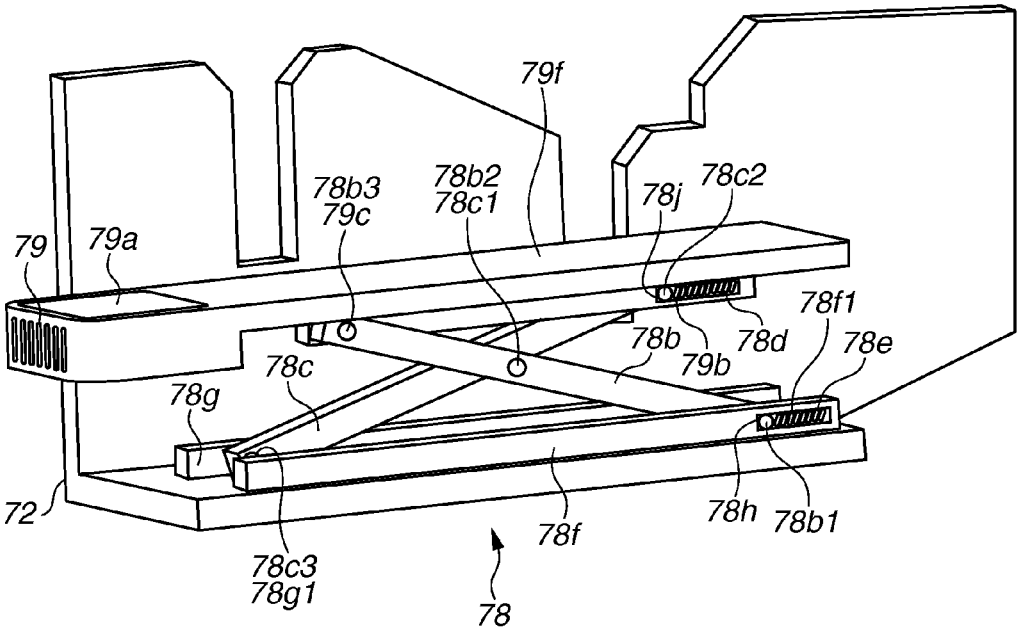
FIG. 6 is a perspective diagram illustrating a configuration of the grip member of the photosensitive cartridge.

As illustrated in FIG. 6, the grip member 79 has a handle portion 79*a*, a notch groove portion 79*b*, and a shaft 79*c*. The displacement mechanism 78 includes a first link member 78*b*, a second link member 78*c*, a first urging member 78*d*, a second urging member 78*e*, a first engagement member 78*f*, and a second engagement member 78*g*. The first engagement member 78*f* has a notch groove portion 78*f*1, and is fixed to the left side cover 72 by, for example, a screw. The first link member 78*b* has a shaft 78*b*1, a first aperture portion 78*b*2, and a second aperture portion 78*b*3. On the other hand, the second link member 78*c* has a first shaft 78*c*1, a second shaft 78*c*2, and a first aperture portion 78*c*3.

The second engagement member 78*g* has a shaft 78*g*1 and is fixed to the left side cover 72 by, for example, a screw. In the present exemplary embodiment, a compression spring is used for each of the first urging member 78*d* and the second urging member 78*e*. The first urging member 78*d* and the second urging member 78*e* are inserted into the notch groove portion 79*b* of the grip member 79 and the notch groove portion 78*f*1 of the first engagement member 78*f*, respectively. The first shaft 78*c*1 of the second link member 78*c* rotatably engages with the first aperture portion 78*b*2 of the first link member 78*b*. Further, the shaft 79*c* of the grip member 79 rotatably engages with the second aperture portion 78*b*3 of the first link member 78*b*. Furthermore, the shaft 78*g*1 of the second engagement member 78*g* rotatably engages with the first aperture portion 78*c*3 of the second link member 78*c*.

In addition, the shaft 78*b*1 of the first link member 78*b* slidably engages with the notch groove portion 78*f*1 of the first engagement member 78*f*, and the second shaft 78*c*2 of the second link member 78*c* slidably engages with the notch groove portion 79*b* of the grip member 79.

[Attachment/Detachment of Photosensitive Cartridge to/from Main Body of Apparatus]

Next, attachment/detachment of the photosensitive cartridge C to/from the main body A of the image forming apparatus will be described with reference to FIGS. 7A and 8B.

Figure 7A:
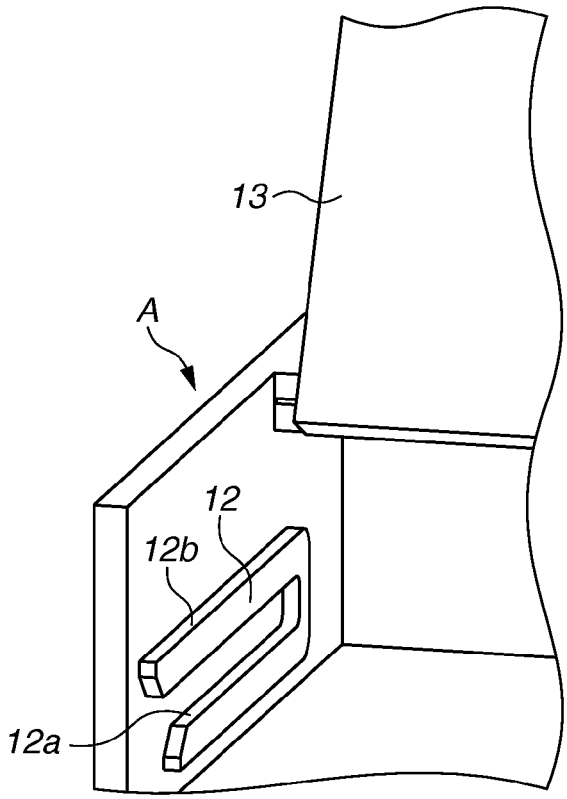
FIGS. 7A and 7B are perspective diagrams illustrating a configuration of attaching/detaching the photosensitive cartridge to/from a main body of the image forming apparatus.
Figure 7B:
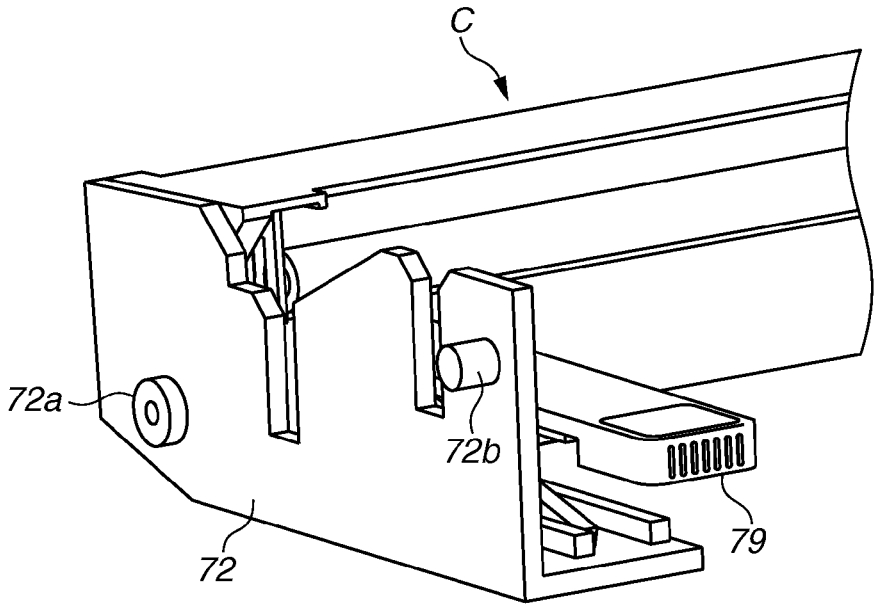
Figure 8A:
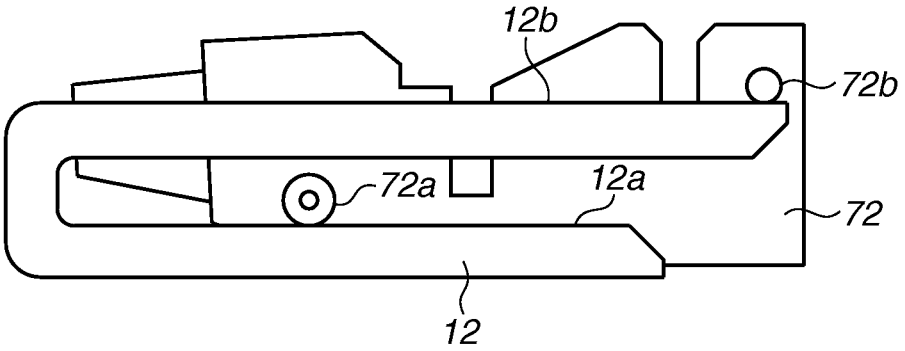
FIGS. 8A and 8B are side views illustrating the configuration of attaching/detaching the photosensitive cartridge to/from the main body of the image forming apparatus.
Figure 8B:
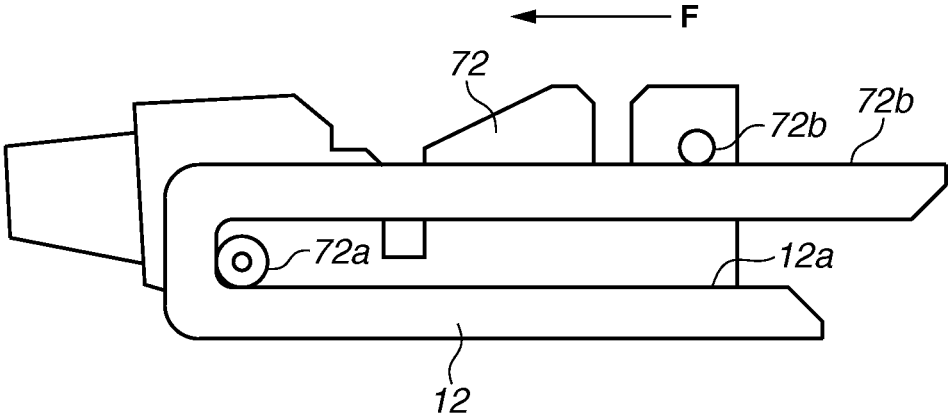

FIG. 7A is a schematic diagram of a state where an open/close door 13 of the main body A of the image forming apparatus is open, and FIG. 7B is a perspective diagram of a side of the photosensitive cartridge C. FIGS. 8A and 8B are side views illustrating a process of attaching/detaching the photosensitive cartridge C to/from the main body A of the image forming apparatus. In the present exemplary embodiment, the configurations on the left and right sides are similar and therefore, FIGS. 7A to 8B illustrate only one side (the side where the left side cover 72 is present). As illustrated in FIG. 7A, the main body A of the image forming apparatus has the open/close door 13 and a photosensitive cartridge guide member 12, to allow attachment/detachment of the photosensitive cartridge C to/from the main body A of the image forming apparatus.

On the other hand, as illustrated in FIG. 7B, the photosensitive cartridge C includes protrusions 72*a* and 72*b* to be guided on the left side cover 72. A user grips the grip member 79 and inserts the protrusions 72*a* and 72*b* to be guided in an F direction in FIG. 8B along guide portions 12*a* and 12*b*, to attach the photosensitive cartridge C to the main body A of the image forming apparatus. Here, when the user attaches the photosensitive cartridge C to the main body A of the image forming apparatus, the grip member 79 is located at the first position. At the first position, the first link member 78*b* and the second link member 78*c* are lifted upward by the first urging member 78*d* and the second urging member 78*e* (FIG. 6).

[Movement of Grip Member Associated with Attachment of Developing Cartridge]

Next, movement of the grip member 79 of the photosensitive cartridge C at the time when the developing cartridge D is attached to the photosensitive cartridge C will be described with reference to FIGS. 1A to 1C and FIG. 6. The left side cover 72 of the photosensitive cartridge C has guide grooves 72*c* and 72*d* as a guide portion for the developing cartridge D. On the other hand, the developing cartridge D has protruding portions 26*a* and 26*b* to be guided by the guide grooves 72*c* and 72*d*. The attachment of the developing cartridge D is completed by inserting the protruding portions 26*a* and 26*b* of the developing cartridge D along the guide grooves 72*c* and 72*d* of the photosensitive cartridge C, after the photosensitive cartridge C is attached to the main body A of the image forming apparatus. When the developing cartridge D is attached to the photosensitive cartridge C, a force receiving portion 79*f* of the grip member 79 receives a force exerted by self-weight of the developing cartridge D. Therefore, the first urging member 78*d* and the second urging member 78*e* of the displacement mechanism 78 are compressed (see FIG. 6), and the grip member 79 is moved in a G direction (FIGS. 1A and 1B). When the attachment of the developing cartridge D to the photosensitive cartridge C is completed, the first urging member 78*d* and the second urging member 78*e* continue being compressed by the self-weight of the developing cartridge D, and the grip member 79 remains at the second position (FIG. 1C). At this moment, the protruding portions 26*a* and 26*b* of the developing cartridge D abut on the bottoms of the guide grooves 72*c* and 72*d*, to thereby be positioned relative to the photosensitive cartridge C.

In this way, by the attachment of the developing cartridge D, the grip member 79 is moved to the second position for retraction from the attachment region B of the developing cartridge D. In other words, when the developing cartridge D is attached to the photosensitive cartridge C and gripping of the grip member 79 is unnecessary, the grip member 79 moves downward. Therefore, as compared with a case where the grip member 79 is fixed at the first position for gripping the grip member 79, a large capacity for accommodating a developer of the developing cartridge D can be secured by a space for the downward movement of the grip member 79.

[Detachment of Photosensitive Cartridge from Apparatus Main Body]

Figure 9A:
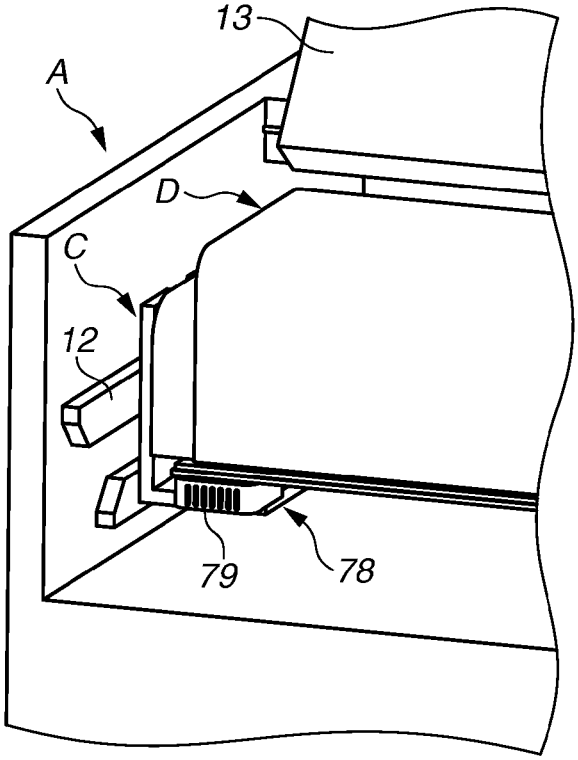
FIGS. 9A and 9B are perspective diagrams illustrating how to remove the photosensitive cartridge from the main body of the image forming apparatus.
Figure 9B:
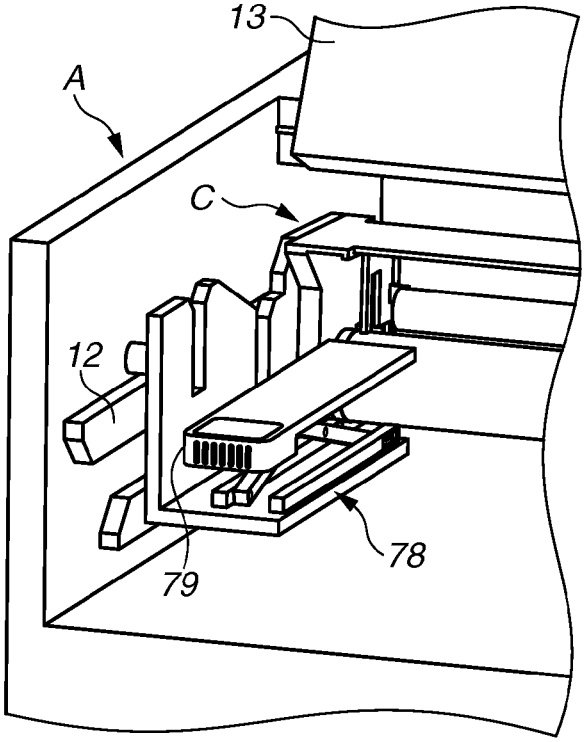

How to remove the photosensitive cartridge C from the main body A of the image forming apparatus will be described with reference to FIGS. 9A and 9B. FIG. 9A is a perspective diagram of a state where the open/close door 13 is open when the photosensitive cartridge C is attached to the main body A of the image forming apparatus and the developing cartridge D is attached to the photosensitive cartridge C. Further, FIG. 9B is a perspective diagram of a state where the developing cartridge D in the state of FIG. 9A is drawn to the outside of the main body A of the image forming apparatus.

When the photosensitive cartridge C has reached the end of life or jam is to be handled, at first, the developing cartridge D is removed from the main body A of the image forming apparatus by pulling the developing cartridge D upward relative to the photosensitive cartridge C. When the developing cartridge D is removed, the grip member 79 of the photosensitive cartridge C located at the second position by the self-weight of the developing cartridge D is displaced to the first position (FIG. 9B). This increases visibility of the grip member 79, so that the user can draw the photosensitive cartridge C from the main body A of the image forming apparatus by gripping the grip member 79.

As described above, the grip member 79 of the photosensitive cartridge C according to the present exemplary embodiment can move between the second position and the first position. Therefore, it is possible to improve the visibility of the grip member 79.

[Relationship Between Attachment Region of Developing Cartridge and Grip Member]

Next, a relationship between the attachment region B of the developing cartridge D and the grip member 79 will be described with reference to FIG. 10.

FIG. 10 is a perspective diagram illustrating both a state where the grip member 79 of the photosensitive cartridge C is at the first position and a state where the grip member 79 of the photosensitive cartridge C is at the second position. As illustrated in FIG. 10, when the grip member 79 is located at the first position, the grip member is in a state where the grip member 79 enters the attachment region B where the developing cartridge D of the photosensitive cartridge C is attached. Such a configuration brings, in addition to the above-described effects, a situation where it is easy for a user to grip the grip member 79. Moreover, since the attachment region B is utilized to bring the situation where it is easy to grip the grip member 79, it is not necessary to provide a dedicated region, so that downsizing of the main body A of the image forming apparatus can be realized.

Figure 11:
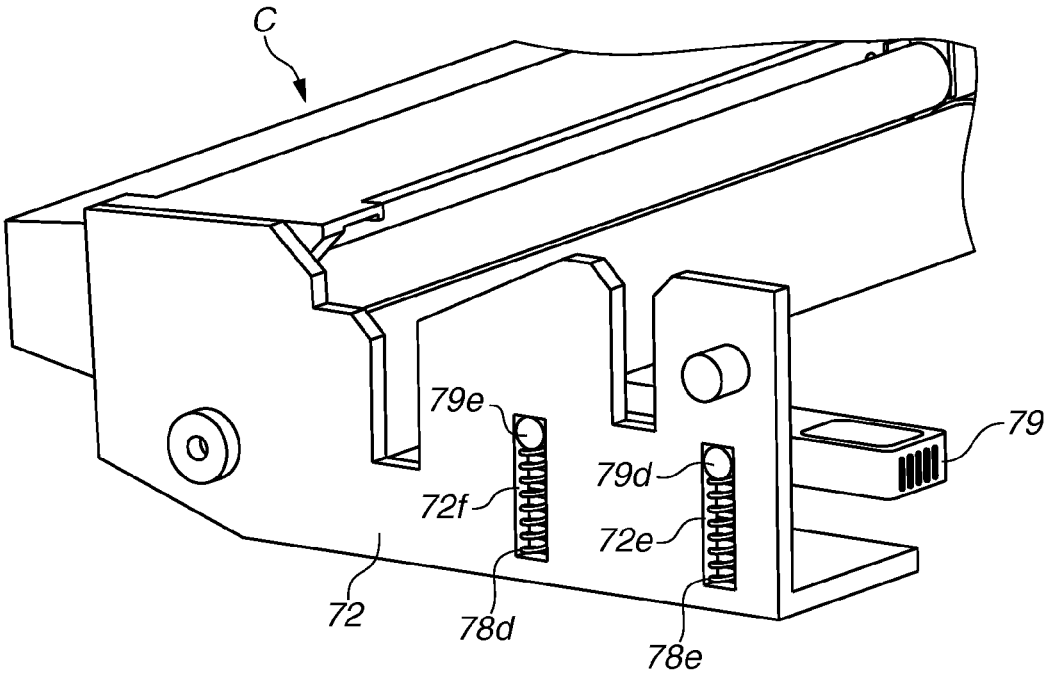
FIG. 11 is a perspective diagram illustrating a modification of the grip member and a displacement mechanism provided in the photosensitive cartridge.

Here, in the present exemplary embodiment, the grip member 79 of the photosensitive cartridge C is linked to the first urging member 78*d* and the second urging member 78*e* by the first link member 78*b* and the second link member 78*c*. However, to simplify the configuration, a configuration illustrated in FIG. 11 may be used. FIG. 11 is perspective diagram illustrating a modification of the present exemplary embodiment. In this modification, the displacement mechanism 78 includes only the urging members 78*d* and 78*e*. In the configuration of FIG. 11, the urging members 78*d* and 78*e* are inserted into notch groove portions 72*e* and 72*f* provided in the left side cover 72, respectively. Further, the grip member 79 has shafts 79*e* and 79*d* that abut on the urging members 78*d* and 78*e*, respectively. The grip member 79 may be thus displaced from the second position to the first position.

Finally, the effects of the above-described exemplary embodiment will be summarized as follows. According to the invention of the above-described exemplary embodiment, it is possible to improve the visibility of the grip member provided in the photosensitive cartridge, to which the developing cartridge is detachably attachable, in the state where the photosensitive cartridge is detachably attached to the image forming apparatus. It is also possible to improve the operability of attaching/detaching the photosensitive cartridge. Moreover, it is possible to achieve compatibility between these improvements and the downsizing of the image forming apparatus to which the above-described photosensitive cartridge is detachably attachable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-008934 filed Jan. 21, 2014, which is hereby incorporated by reference herein in its entirety.

What is claimed is:

1. A photosensitive cartridge detachably attachable to a main body of an image forming apparatus, the photosensitive cartridge comprising:

a photosensitive member;

an attachment region provided to detachably attach a developing cartridge having a developing member for developing a latent image formed on the photosensitive member; and a grip member configured to be gripped at a time when the photosensitive cartridge is attached to and detached from the main body of the image forming apparatus, the grip member being movable between a first position at which the grip member enters the attachment region in a case where the developing cartridge is not attached to the photosensitive cartridge, and a second position at which the grip member retracts from the attachment region in a case where the developing cartridge is attached to the photosensitive cartridge.

2. The photosensitive cartridge according to claim 1, wherein the first position is placed higher than the second position in a state where the photosensitive cartridge is attached to the main body of the image forming apparatus.

3. The photosensitive cartridge according to claim 1, wherein the photosensitive cartridge is detachably attachable to the main body of the image forming apparatus while the grip member is gripped in a state where the developing cartridge is not attached to the photosensitive cartridge, and the developing cartridge is detachably attachable to the photosensitive cartridge in a state where the photosensitive cartridge is attached to the main body of the image forming apparatus.

4. The photosensitive cartridge according to claim 1, further comprising an urging member configured to urge the grip member in a direction from the second position toward the first position.

5. The photosensitive cartridge according to claim 4, further comprising a link member configured to move the grip member between the first position and the second position, wherein the urging member is configured to urge the link member.

6. The photosensitive cartridge according to claim 1, wherein the grip member includes a force receiving portion that receives a force for causing movement from the first position to the second position at a time when the developing cartridge is attached in the attachment region.

7. The photosensitive cartridge according to claim 1, wherein the grip member is provided on each of one side and another side of the photosensitive cartridge in an axial direction of the photosensitive member.

8. The photosensitive cartridge according to claim 1, further comprising a guide portion configured to guide the developing cartridge to the attachment region.

9. An image forming apparatus forming an image on a recording medium, the apparatus comprising:

a photosensitive cartridge configured to be detachably attachable to a main body of the image forming apparatus; and a conveyance mechanism configured to convey the recording medium, wherein the photosensitive cartridge includes a photosensitive member, an attachment region provided to detachably attach a developing cartridge having a developing member for developing a latent image formed on the photosensitive member, and a grip member configured to be gripped at a time when the photosensitive cartridge is attached to and detached from the main body of the image forming apparatus, the grip member being movable between a first position at which the grip member enters the attachment region in a case where the developing cartridge is not attached to the photosensitive cartridge, and a second position where the grip member retracts from the attachment region in a case where the developing cartridge is attached to the photosensitive cartridge.

10. The image forming apparatus according to claim 9, wherein the first position is placed higher than the second position in a state where the photosensitive cartridge is attached to the main body of the image forming apparatus.

11. The image forming apparatus according to claim 9, wherein the photosensitive cartridge is detachably attachable to the main body of the image forming apparatus while the grip member is gripped in a state where the developing cartridge is not attached to the photosensitive cartridge, and the developing cartridge is detachably attachable to the photosensitive cartridge in a state where the photosensitive cartridge is attached to the main body of the image forming apparatus.

12. The image forming apparatus according to claim 9, wherein the photosensitive cartridge further includes an urging member configured to urge the grip member in a direction from the second position toward the first position.

13. The image forming apparatus according to claim 12, wherein the photosensitive cartridge further includes a link member configured to move the grip member between the first position and the second position, and wherein the urging member urges the link member.

14. The image forming apparatus according to claim 9, wherein the grip member includes a force receiving portion that receives a force for causing movement from the first position to the second position at a time when the developing cartridge is attached in the attachment region.

15. The image forming apparatus according to claim 9, wherein the grip member is provided on each of one side and another side of the photosensitive cartridge in an axial direction of the photosensitive member.

16. The image forming apparatus according to claim 9, wherein the photosensitive cartridge further includes a guide portion configured to guide the developing cartridge to the attachment region.

* * * * *